US005522291A

United States Patent [19]

Liu

[11] Patent Number: 5,522,291

[45] Date of Patent: Jun. 4, 1996

[54] TOOL HANDLE HAVING A TOOL KIT

[76] Inventor: Tsai-Fa Liu, No. 88, Lane 412, Chen-hsing Rd., Taichung City, Taiwan

[21] Appl. No.: 380,630

[22] Filed: Jan. 30, 1995

[51] Int. Cl.[6] ..... B25G 1/08

[52] U.S. Cl. ..... 81/490; 81/177.4

[58] Field of Search ..... 81/490, 177.4, 81/437–439

[56] References Cited

U.S. PATENT DOCUMENTS

| | | | |
|---|---|---|---|
| 4,893,529 | 1/1990 | Lin | 81/177.4 |
| 4,934,223 | 6/1990 | Wong | 81/177.4 X |
| 5,421,225 | 6/1995 | Chen | 81/177.4 X |

*Primary Examiner*—D. S. Meislin

*Attorney, Agent, or Firm*—Beveridge, DeGrandi, Weilacher & Young

[57] ABSTRACT

A tool handle having a tool includes a handle having an extended portion with a driving element and a switching button and a recess disposed inside the handle. A tool kit containing various tool parts is accommodated within the recess. An axial rod provided at one end of the recess of the handle and a corresponding hole in the tool kit pivotally connect the tool kit with the recess. The tool kit has a retaining piece for engagement with an engaging edge at the other end of the handle for positioning the tool kit in the recess.

15 Claims, 3 Drawing Sheets

TOOL HANDLE HAVING A TOOL KIT

BACKGROUND OF THE INVENTION (a) Technical Field

The present invention relates generally to a tool handle having a tool kit, and more particularly to a hand tool which is convenient to use and carry, in which a driving element is disposed on an extended portion of the handle so that the driving element is in alignment with the user's arm while he/she is holding the handle, thereby facilitating application of force.

(b) Description of the Prior Art

Hand tools are widely used in factories and everyday life. In the past, most hand tools had only one specific function, so that people would have to have several tools at one time, and have to find space for storing them after use. To remove this drawback, manufacturers have offered various kinds of tool sets in which various kinds of tool bits or different sizes of sleeves or other tool parts are provided in addition to a tool handle to meet the different needs of users.

FIG. 5 shows one of the conventional tool sets. It mainly comprises a handle 30 having a driving element 31 extending outwardly from an end portion thereof at a suitable angle thereto. A switching button 32 is also provided thereon for controlling the rotational direction of its ratchet. The driving element 31 may be fitted with different kinds of tool bits or sleeves or, if necessary, an extended rod 33. The other end portion of the handle 30 is provided with a slot 34 for holding a tool kit 40 inserted therein. A plurality of compartments 41 are provided in the tool kit 40 for containing various tool parts. A nose 42 is disposed on a surface of the tool kit 40 near its end for engagement with a retaining hole 35 correspondingly provided in the slot 34.

However, the above-described conventional tool handle having a tool kit has the following drawbacks:

1. The connection between the handle 30 and the tool kit 40 by means of the nose 42 and the retaining hole 35 is not ideal. This is because a tool kit 40 which is loaded with tool parts is very heavy. If the tool kit 40 is held in place within the slot 34 by merely the nose 42 engaging with the retaining hole 35, the tool kit 40 cannot be held firmly therein. In particular, after a period of use, due to wear on the nose 42 and the hole 35, the tool kit 40 may easily slip out of the slot 34 even while the tool handle 30 is being held in use.
2. Since the tool kit 40 is designed to match the shape of the tool handle 30 and the slot 34, the user has to pay attention to the orientation of the tool kit 40 when inserting the tool kit 40 back into the slot 34 after tool kit 40 is pulled out to obtain the needed tool parts.
3. In the above conventional tool handle, the driving element 31 is provided in the end portion of one side of the handle 30. When the user applies a force, the line of force exerted by the user on the handle is not aligned with the line of action, so that application of force is not easy and torque may concentrate entirely on the driving element 31. The extended rod 33 hence has to bear a greater torque, affecting the structural strength of the tool handle.

SUMMARY OF THE INVENTION

The primary object of the present invention is to provide a tool handle having a tool kit, wherein when the user holds the handle in work, his/her hand wraps around the handle so that the tool kit is secured within a recess of the handle and is prevented from slipping out of the recess of the handle.

Another object of the present invention is to provide a tool handle having a tool kit, wherein the tool kit is accommodated within a recess of the handle and is pivotally connected thereto so that the tool kit may be pulled out or pushed in with ease, eliminating the trouble of paying attention to the orientation of the tool kit in known tool handles having tool kits.

A further object of the present invention is to provide a tool handle having a tool kit, wherein the line of force is in alignment with the hand, facilitating the application of force and preventing possible concentration of torque on a certain point, so that a greater torque may be transmitted and the structural strength of the tool handle may be more ideal.

To achieve the object of the present invention, the tool handle according to the present invention comprises a driving element, the operational direction thereof being controlled by a switching button, provided in one side of a handle, the handle having an interior hollow recess for accommodating a tool kit containing various shapes and sizes of tool parts. The tool kit is connected to the recess of the handle by means of an axial rod disposed at one end of the recess of the handle and a corresponding hole provided in the tool kit, so that the tool kit may be pivotally turned outwardly from the recess of the handle to obtain the required tool parts. The tool kit is also provided with a retaining piece at the other end thereof for engagement with a corresponding engaging edge at an end of the recess of the handle.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
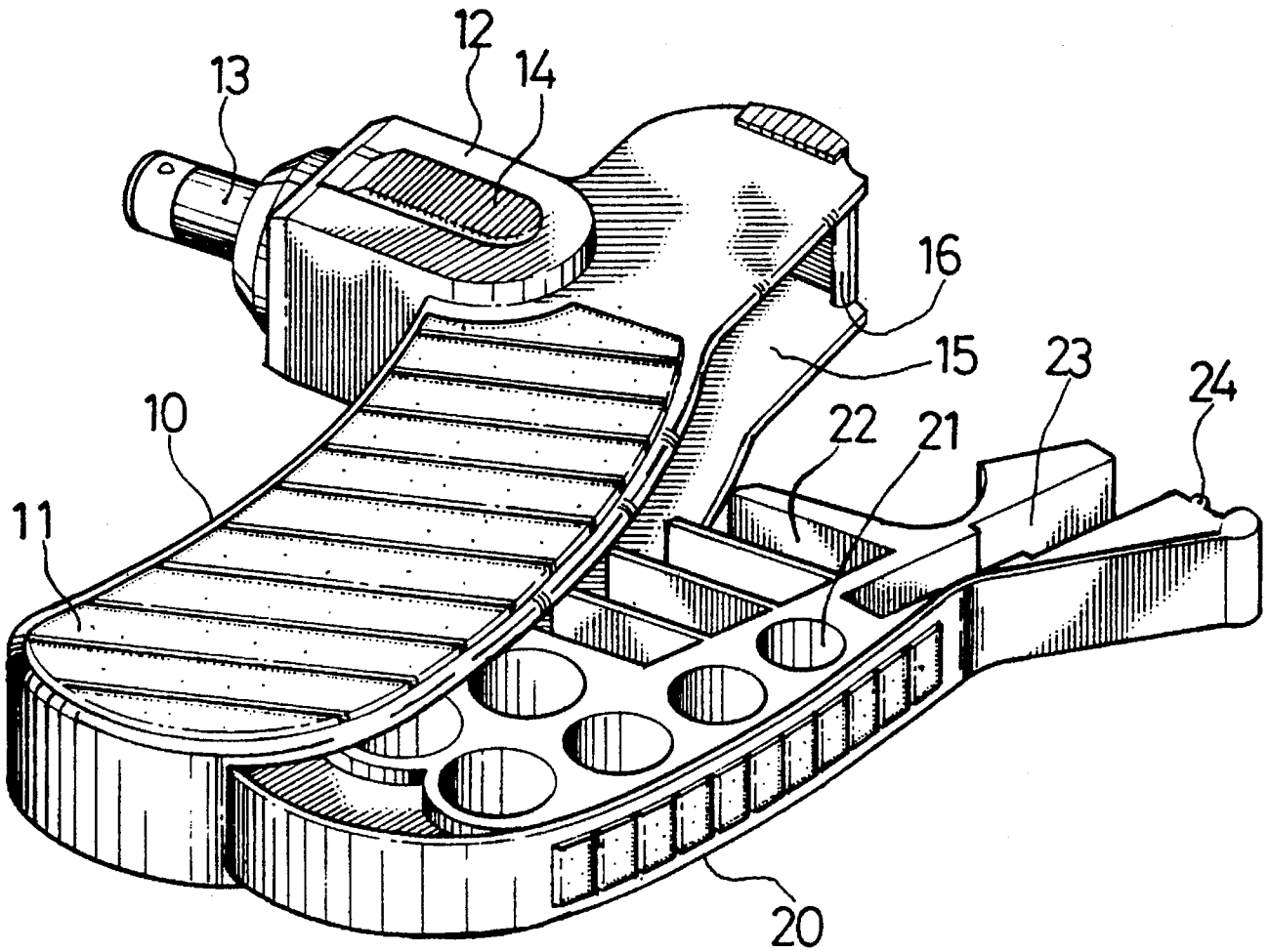
FIG. 1 is a perspective view of the present invention in an assembled state.
Figure 2:
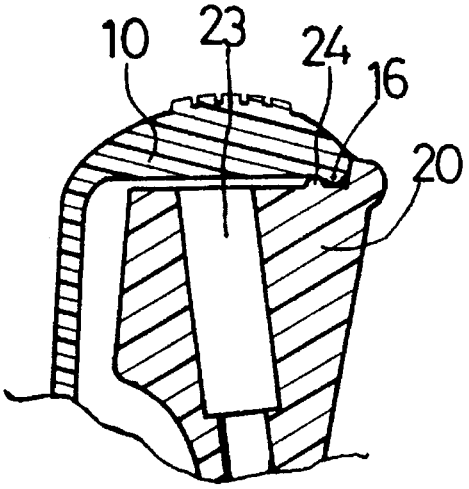
FIG. 2 is a sectional view of a part of the present invention in an assembled state.
Figure 3:
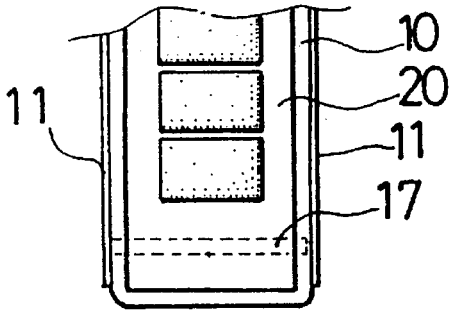
FIG. 3 is a side view of a part of the present invention.

With reference to FIGS. 1, 2 and 3, the hand tool structure according to the present invention mainly comprises a handle 10 and a tool kit 20. The handle 10 has an upper surface and a lower surface, which are respectively adhered with a soft pad 11. The handle 10 further has an extended portion 12 extending from one side near an end thereof, for accommodating a driving element 13. In other words, there is a suitable distance between the driving element 13 and the two ends of the handle 10 for the user to hold on to while exerting a force. The extended portion 12 has a switching button 14 provided on the upper surface of the handle 10 for adjusting the working direction of the driving element 13. The handle 10 is provided with a hollow recess 15. A top end portion of the recess 15 near its lateral side is provided with an engaging edge 16, and an axial rod 17 is provided near a bottom end of the surfaces in cooperation with a corresponding hole of the tool kit 20, thereby the kit 20 may be pivotally connected.

A plurality of sleeve compartments 21 and tool bit compartments 22, as well as an extended rod compartment 23 may be provided in the kit 20 according to the various shapes and sizes of the tool. A retaining piece 24 having considerable resilience is provided at a position corresponding to the engaging edge 16 in the recess 15 of the handle 10 so that the retaining piece 24 may engage with the engaging edge 16 when the kit 20 is pushed into the recess 15.

In actual use, the kit 20 is pivotally turned outwardly from the recess 15 so that the user may pick out the desired tool parts from the sleeve compartments 21, tool bit compartments 22 and the extended rod compartment 23 for fitting into the driving element 13. The kit 20 may then be pushed back into the recess 15 of the handle 10 and positioned in place by the retaining piece 24 engaging with the engaging edge 16.

Figure 4:
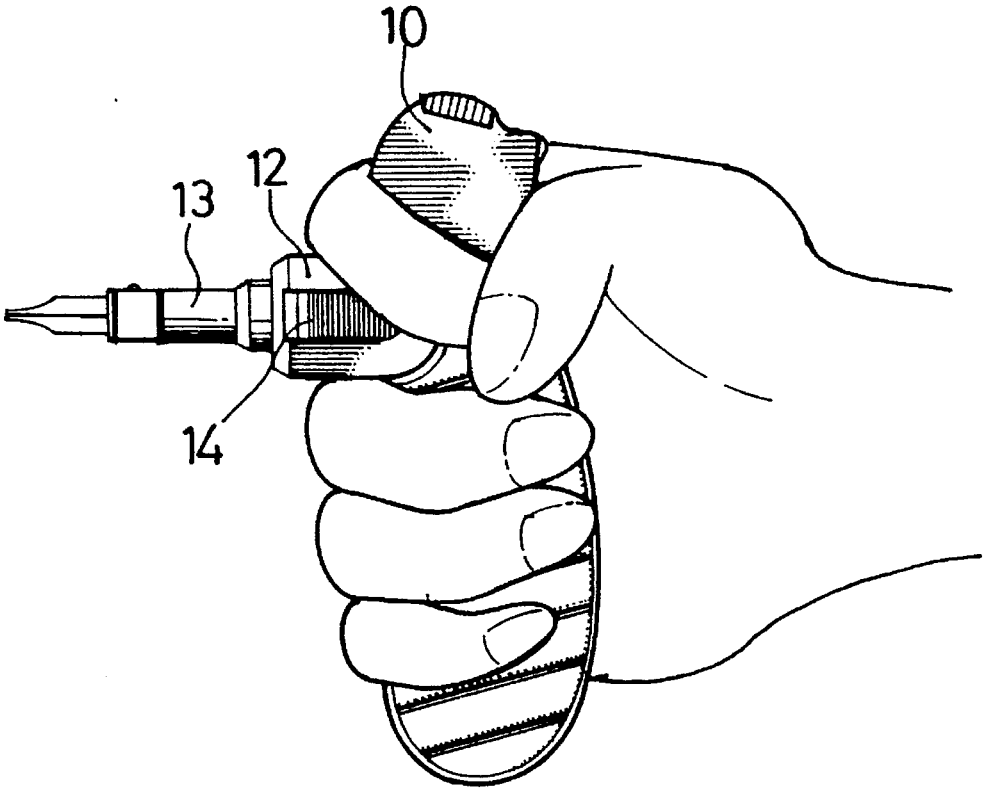
FIG. 4 is schematic view of the present invention in a state of use.
Figure 5:
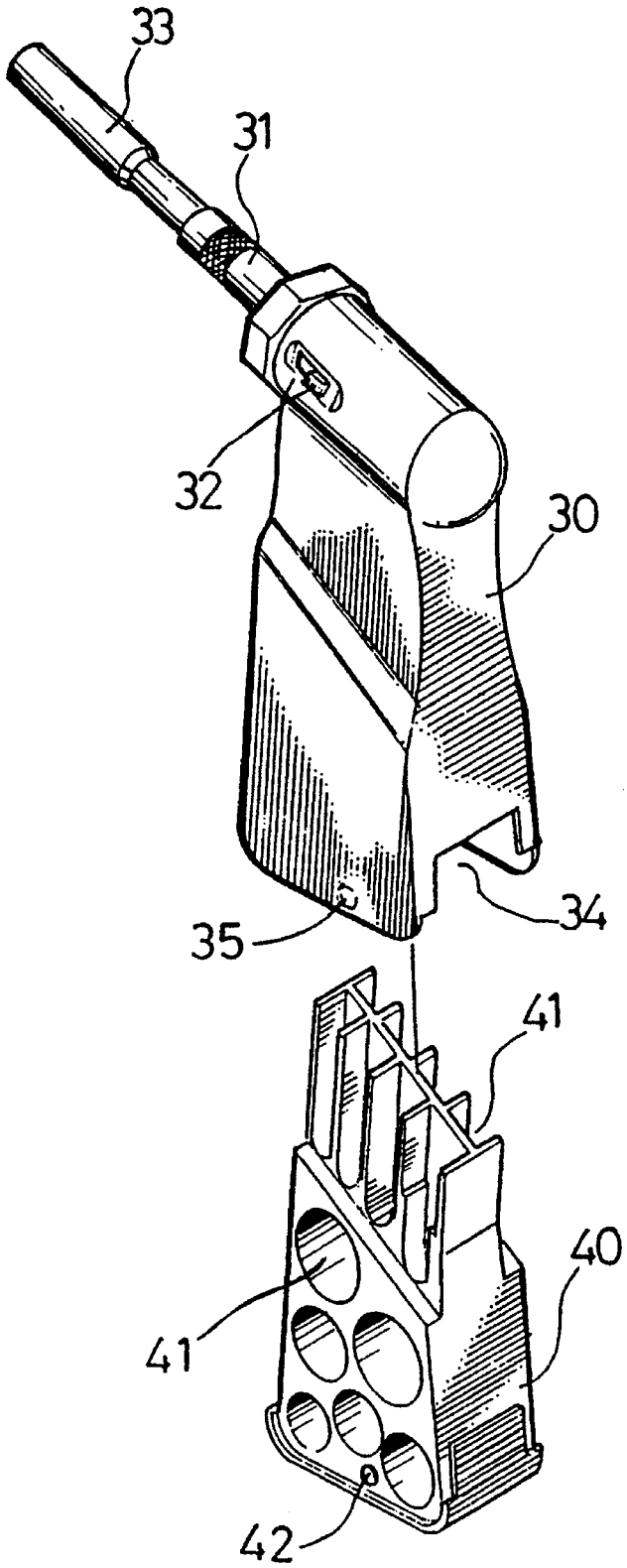
PRIOR ART FIG.5
FIG. 5 is a perspective exploded view of a conventional handle structure containing a took kit.

As shown in FIG. 4, the driving element 13 is disposed at the extended portion in one side of the handle 10 near the end portion thereof. When the user holds the handle 10 of the present invention, he/she may grip the driving element 13 between the index finger and the middle finger to facilitate turning of the tool of the present invention. Additionally, the soft pads 11 adhered to the surfaces of the handle 10 provide comfortable grip of the handle 10.

Although the present invention has been illustrated and described with reference to the preferred embodiment thereof, it should be understood that it is in no way limited to the details of such embodiment but is capable of numerous modifications within the scope of the appended claims.

What is claimed is:

1. A tool handle having a tool kit, comprising:

a handle having an extended portion with a driving element extending from the extended portion, and a switching button provided on a lateral side of said extended portion, said handle further including an engaging edge at a first end thereof, and said handle defining an interior hollow recess, and a tool kit having a plurality of compartments defined therein, wherein the compartments are provided for containing sleeves, tool bits and an extending rod, wherein the compartments are of various shapes and sizes for containing various kinds of hand tools, wherein said tool kit is accommodated within said recess in said handle, said tool kit being pivotally connected to said handle by an axial rod, wherein said tool kit is provided with a retaining piece which engages with said engaging edge provided in the handle to hold said tool kit within said recess.

2. A tool handle having a tool kit as claimed in claim 1, wherein said driving element extending from said extended portion of said handle is positioned at a distance from the first end and a second end of said handle such that said driving element is closer to the first end of said handle than the second end of the handle.

3. A tool handle having a tool kit as claimed in claim 1, wherein the handle includes a first surface and a second surface, and the recess is defined between the first surface and the second surface.

4. A tool handle having a tool kit as claimed in claim 3, wherein the first surface of the handle has a soft pad provided thereon, and the second surface of the handle has a soft pad provided thereon.

5. A tool comprising:

a handle having a first end and a second end, wherein a driving element is provided proximate the first end of the handle, wherein the handle includes a first surface and a second surface, and a recess is defined between the first surface and the second surface, wherein an engaging edge is provided in the recess; and a tool kit pivotally attached to the handle by an axial rod, wherein the tool kit includes a plurality of compartments defined therein, wherein the tool kit is accommodated within the recess in the handle, wherein the tool kit further includes a retaining piece which engages with the engaging edge provided in the recess to hold the tool kit within the recess.

6. A tool as claimed in claim 5, wherein the driving element is provided on an extended portion of the handle, wherein the extended portion of the handle is positioned closer to the first end of the handle than the second end of the handle.

7. A tool as claimed in claim 5, wherein the engaging edge is provided proximate the first end of the handle.

8. A tool as claimed in claim 7, wherein the axial rod is provided proximate the second end of the handle.

9. A tool as claimed in claim 8, wherein the first surface of the handle has a soft pad provided thereon, and the second surface of the handle has a soft pad provided thereon.

10. A tool as claimed in claim 7, wherein the first surface of the handle has a soft pad provided thereon, and the second surface of the handle has a soft pad provided thereon.

11. A tool as claimed in claim 5, wherein the axial rod is provided proximate the second end of the handle.

12. A tool as claimed in claim 11, wherein the first surface of the handle has a soft pad provided thereon, and the second surface of the handle has a soft pad provided thereon.

13. A tool as claimed in claim 5, wherein the first surface of the handle has a soft pad provided thereon, and the second surface of the handle has a soft pad provided thereon.

14. A tool as claimed in claim 5, wherein the driving element is provided on an extended portion which extends from the handle.

15. A tool as claimed in claim 14, wherein a switching button is provided on the extended portion for switching the working direction of the driving element.

* * * * *